US006499862B1

(12) United States Patent
Weigert et al.

(10) Patent No.: US 6,499,862 B1
(45) Date of Patent: Dec. 31, 2002

(54) SPOTLIGHT WITH AN ADJUSTABLE ANGLE OF RADIATION AND WITH AN ASPHERICAL FRONT LENS

(75) Inventors: Dedo Weigert, Munich (DE); Depu Chin, Munich (DE)

(73) Assignee: Dedo Weigert Film GmbH, Munich (DE)

( * ) Notice: Subject to any disclaimer, the term of this patent is extended or adjusted under 35 U.S.C. 154(b) by 0 days.

(21) Appl. No.: 09/484,253

(22) Filed: Jan. 18, 2000

(30) Foreign Application Priority Data

Jan. 15, 1999 (DE) ..... 199 01 391

(51) Int. Cl.[7] ..... F21V 17/00

(52) U.S. Cl. ..... 362/268; 362/285; 362/319; 362/331

(58) Field of Search ..... 362/268, 281, 362/285, 286, 308, 319, 328, 331, 322

(56) References Cited

U.S. PATENT DOCUMENTS

| | | | | |
|---|---|---|---|---|
| 3,833,802 A | | 9/1974 | Fridrich | |
| 4,151,584 A | | 4/1979 | Labrum | 362/302 |
| 4,823,243 A | | 4/1989 | Weigert | |
| 5,016,994 A | * | 5/1991 | Braat | 350/432 |
| 5,083,253 A | * | 1/1992 | Hahnel | 362/306 |
| 5,345,371 A | * | 9/1994 | Cunningham et al. | 362/322 |
| 5,446,637 A | | 8/1995 | Cunningham et al. | |
| 5,584,568 A | * | 12/1996 | Corbasson et al. | 362/268 |
| 5,630,661 A | * | 5/1997 | Fox | 362/322 |
| 5,991,088 A | * | 11/1999 | Mizouchi | 362/268 |
| 6,004,007 A | * | 12/1999 | Weigert | 362/268 |
| 6,092,914 A | * | 7/2000 | Esakoff et al. | 362/268 |
| 6,200,011 B1 | * | 3/2001 | Miller et al. | 362/556 |

FOREIGN PATENT DOCUMENTS

| | | |
|---|---|---|
| DE | 1 140 364 | 11/1962 |
| DE | 2 105 389 | 12/1971 |
| DE | 25 13 959 B2 | 10/1975 |
| DE | 1 46 213 | 9/1979 |
| DE | 29 01 320 A1 | 7/1980 |
| DE | 32 07 926 A1 | 9/1983 |
| DE | 35 05 771 C2 | 8/1986 |
| DE | 86 18 732.5 | 10/1986 |
| DE | 36 29 253 A1 | 3/1988 |
| DE | 86 22 788.2 | 8/1988 |
| DE | 89 06 698.7 | 10/1989 |
| DE | 40 13 421 A1 | 10/1991 |
| DE | 93 01 883.5 | 7/1993 |
| DE | 298 03 429 U1 | 6/1998 |
| DE | 298 04 251 U1 | 6/1998 |
| EP | 0828111 | 3/1998 |
| EP | 0846913 A1 | 6/1998 |
| EP | 0 846 913 | 6/1998 |
| EP | 0828111 A1 | 11/1998 |
| WO | WO99/01694 | 1/1999 |

* cited by examiner

*Primary Examiner*—Sandra O'Shea
*Assistant Examiner*—Peggy A Neils
(74) *Attorney, Agent, or Firm*—Birch, Stewart, Kolasch & Birch, LLP

(57) ABSTRACT

A spotlight has an adjustable angle of radiation with modification of the angle of radiation being achieved in a manner other than by shading a beam path with a screen or mask. The spotlight has an interior light source (4) and a first lens (2) that is structured as a front lens. The first lens (2) is an aspherical lens.

47 Claims, 14 Drawing Sheets

SPOTLIGHT WITH AN ADJUSTABLE ANGLE OF RADIATION AND WITH AN ASPHERICAL FRONT LENS

BACKGROUND OF THE INVENTION

This application claims a priority based on German Patent Application DE 199 01 391.8, filed Jan. 15, 1999, and the disclosure of that application is incorporated herein by reference.

The invention relates to a spotlight with an adjustable angle of radiation, wherein modification of the angle of radiation is achieved in a manner other than by shading a beam path with a screen or mask, having a light source arranged within the spotlight and a first lens that is a front lens of the spotlight. Profile projectors, in which small modifications of angles of radiation occur as a side effect during image focusing, do not belong to this class of spotlights.

Spotlights with adjustable angles of radiation as known in the prior art can be divided into three classes, namely stepped lens spotlights, spotlights with very deep reflectors, and spotlights with an optical unit, including a second lens, a light source, and a reflector, that is moveable relative to a front lens.

Conventional stepped lens spotlights have a single stepped lens (Fresnel lens). Incandescent bulbs, halogen bulbs, or discharge lamps are used as light sources in these stepped-lens spotlights. The light source and a reflector are mounted on a slide at a fixed distance from each other. The slide is movable relative to the Fresnel lens. Focusing is achieved by moving the slide. However, in stepped lens spotlights of this type, a significant effective loss of light occurs at focus settings with small angles of radiation. Since there is no second lens to concentrate the light toward the Fresnel lens, a large portion of the light emitted by the light source is simply absorbed by an inner wall of a housing at such focus settings, which results in loss of light and unneeded heating of the housing.

In general, a spotlight with a very deep reflector is constructed so that the lamp and reflector can be displaced relative to each other, but in these spotlights the lamp remains inside the reflector, along its optical axis, at all times. The angle of radiation of these spotlights is modified by changing the position of the lamp within the reflector. However, a focusing path that can be achieved in this way is minimal, so that an angle of radiation can be varied only within relatively narrow limits. Spotlights of this type do provide a high degree of light efficiency, but they exhibit unfavorable light distribution in nearly all lamp positions. A reason for this generally poor light distribution is that a particular fixed reflector shape provided respectively for each one of these spotlights, relative to a resulting light distribution, can be optimally designed for only a single lamp position. Uneven light distribution occurs when the lamp or the reflector are moved for focusing purposes, for example. Therefore, to improve light distribution, replaceable front lenses are often used in spotlights of this type. These lenses may have frosted properties, a honeycomb structure, or other specially formed features that serve to provide additional focusing or light dispersion, in which, however, aspherical front lenses have never before been used in spotlights with adjustable angles of radiation. With these spotlights, therefore, variously modified front lenses must be used for various angles of radiation. For many such spotlights with very deep reflectors, both the lamps and the reflectors are mounted in fixed positions in the housings, i.e. the angles of radiation are modified in such cases exclusively by replacing variously-shaped front lenses. This entails a relatively significant amounts of labor and time spent changing front lenses if such a spotlight is-used in a situation in which the angle of radiation must be often changed.

Spotlights with adjustable angles of radiation of the third group, in accordance with the above classification, are a significant improvement over the spotlights described above. Such a spotlight is disclosed by U.S. Pat. No. 4,823,243 and European Patent 0 846 913. This spotlight has a light source, a reflector associated with the light source, a first collector lens (front lens) placed in a beam path in a direction of a beam of the light source-reflector combination, and a second collector lens located between the light source and the first collector lens. The reflector, the light source, and the second collector lens are mounted as an optical unit that is movable relative to the first collector lens along an optical axis of the spotlight. Inside the optical unit disclosed in U.S. Pat. No. 4,823,243 a spacing between the light source and the second collector lens is adjustable. Very similar spotlights are also commercially available in which, however, mutual spacings between a reflector, a light source, and a second collector lens cannot be modified. In the latter spotlights, optical units can be moved only as fixed wholes. By contrast, in the spotlight disclosed in European Patent 0 846 913, within the optical unit that can be moved relative to the first collector lens, both the spacing between the light source and the second collector lens and the spacing between the light source and the reflector can be modified. Common to all the spotlights described in this paragraph, however, is that the front lens is a spherical lens.

The spotlights with adjustable angles of radiation specified in the previous paragraph, one of which is shown in a schematic view in FIG. 5, provide a large modification range of angles of radiation (see FIGS. 6*a*, 6*b* herein), and achieve a high degree of light efficiency in terms of energy required to operate spotlights. In addition, they provide exceptionally even light distribution. Moreover, such a spotlight no longer produces scattered light (light intensity$\leqq$50% of maximum light intensity), as defined according to a conventional concept, owing to a sharp slope of the light intensity at the edge of the lighted area. As shown in FIGS. 6*a*, 6*b*, a characteristic illuminance curve of a lighted field does exhibit small increases in intensity at the edge, the size of which depends on the setting of the optical unit, but the light intensity across the entire lighted area is largely constant. Increases in intensity at the edge do not occur in the spot setting. They appear only upon movement of the spotlight out of the spot setting and then increase continuously in size until a critical setting in the angle of radiation between the spot setting and the flood setting is achieved, in which the size of the intensity increase at the edge reaches a maximum. Upon further movement of the spotlight in a direction toward the flood setting, the size of the intensity increase at the edge once again decreases continuously.

If graining, or pocking, is provided on a surface of the second lens so that a micro-lens structure arises on the grained surface, the intensity increase that occurs at the edge in the characteristic illuminance curve is dampened, but not entirely eliminated. Moreover, this reduction in intensity increase at the edge is achieved at a cost of increased scattering and loss of light.

It is an object of this invention to provide a spotlight of the type mentioned in the opening paragraph above that provides a more even light distribution, particularly in angle of radiation settings outside the spot setting, than do such spotlights known in the prior art.

SUMMARY

According to principles of this invention, a spotlight, whose angle of radiation is modified in a manner other than by shading a beam path with a screen or mask, includes an interior light source and a first lens that is a front lens of the spotlight, with the first lens being an aspherical lens.

Use of an aspherical lens as a first lens, i.e. as a front lens of such a spotlight, ensures a more even light distribution outside of the spot setting in comparison to such spotlights known in the prior art.

The term "aspherical lenses" means lenses in which at least one partial surface is not spherical in structure, with plane faces being always counted as spherical surfaces. Examples of aspherical lenses are lenses having one ellipsoid and one spherical surface, and lenses having one spherical surface and one hyperbolic surface. Fresnel lenses having aspherically structured partial surfaces are also aspherical lenses according to the above definition.

Advantageous and preferred embodiments of spotlights having enhanced features of this invention are described herein.

In one embodiment of a spotlight of this invention—in which a second lens is placed in a light-beam path between the light source and the first lens, with a reflector, the light source, and the second lens being mounted as an optical unit that is movable along an optical axis of the spotlight relative to the first lens—prior-art edge-intensity increases in light distributions are entirely smoothed out, and particularly uniform lighting of the lighted area is achieved, with a high degree of variability of the angle of radiation, independently of selected settings of the angle of radiation.

In a spotlight according to the invention in which the second lens is grained on at least one surface, the graining does not need to be made as deep as graining of a second lens commonly known in the prior art. In this way, loss of light is reduced and, as is particularly important in the spot setting, greater light intensity is achieved with the same input power.

In a particularly preferred embodiment in which the second lens is an aspherical lens, light efficiency in the spot setting is increased in comparison with a second lens structured as a spherical lens, with the same input power.

Particularly uniform light distribution is achieved with embodiments of the spotlight wherein the lenses have surfaces formed in accordance with the equations disclosed and claimed herein.

In an embodiment of the spotlight according to the invention in which a spacing between the light source and the second lens is adjustable within an optical unit, it is ensured that the spotlight also has all the advantages of the spotlight disclosed in U.S. Pat. No. 4,823,243.

In an embodiment of the spotlight of the invention in which a spacing between the light source and the reflector is adjustable within the optical unit, it is ensured that the spotlight also has all the advantages of the spotlight disclosed in European Patent 0 846 913, specifically the very great variability of the angle of radiation and of the light intensity.

BRIEF DESCRIPTION OF THE DRAWINGS

The invention is described and explained in more detail below using embodiments shown in the drawings. The described and drawn features can be used individually or in preferred combinations in other embodiments of the invention. The foregoing and other objects, features and advantages of the invention will be apparent from the following more particular description of preferred embodiments of the invention, as illustrated in the accompanying drawings in which reference characters refer to the same parts throughout the different views. The drawings are not necessarily to scale, emphasis instead being placed upon illustrating principles of the invention in a clear manner.

Each of FIGS. 1*a*–1*e* is a schematic cross-sectional view of one embodiment of a spotlight of this invention, with an optical unit—comprising a light source, a reflector, and second lens—being in different positions in different views, ranging from as close as possible to the first lens, to a position as distant as possible from the first lens;

Figure 4A:
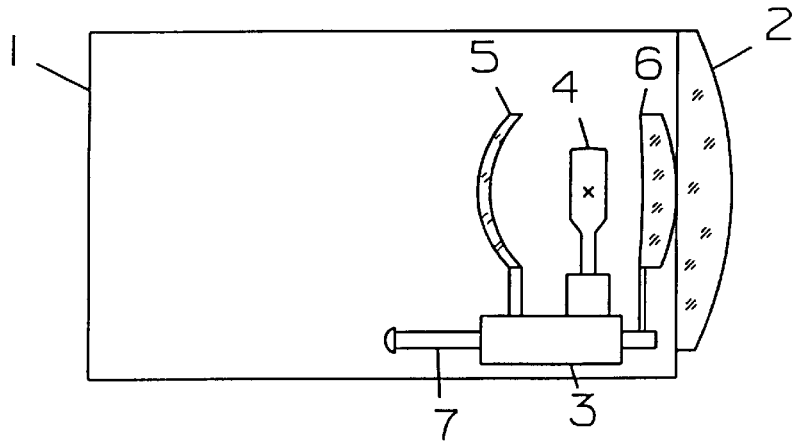
Figure 4B:
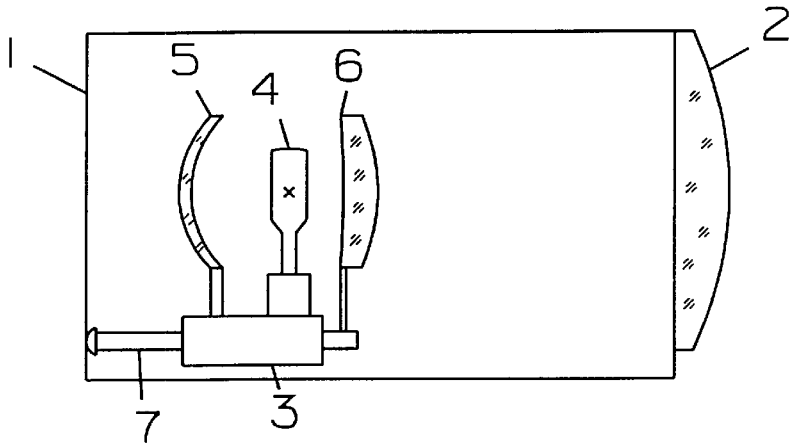
Figure 4C:
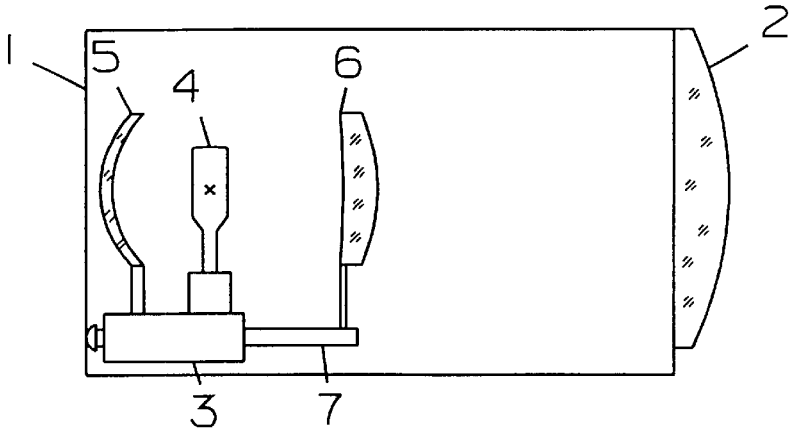
Figure 5:
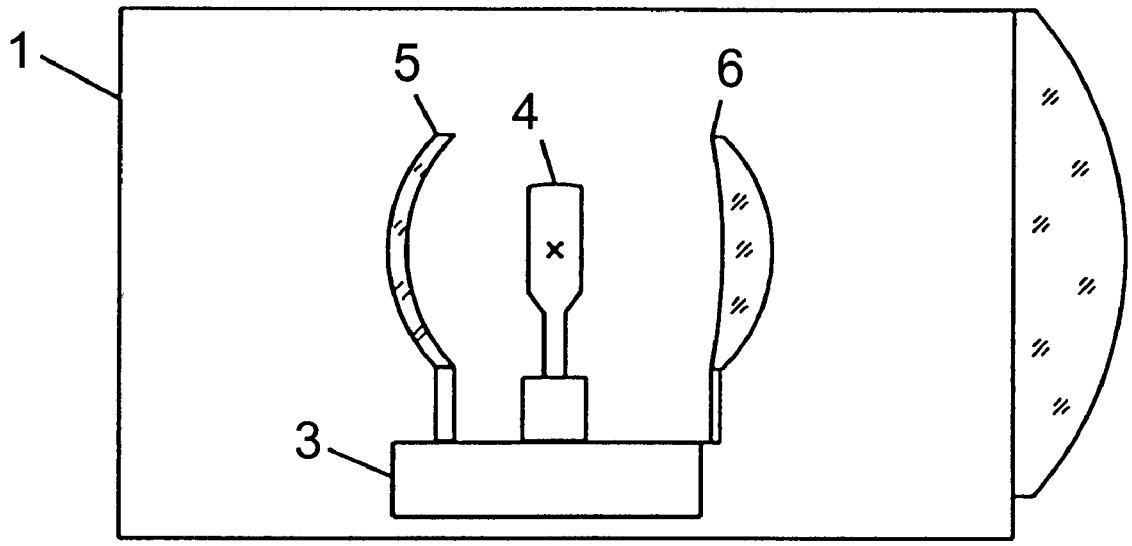
Fig.5 PRIOR ART
Figure 6A:
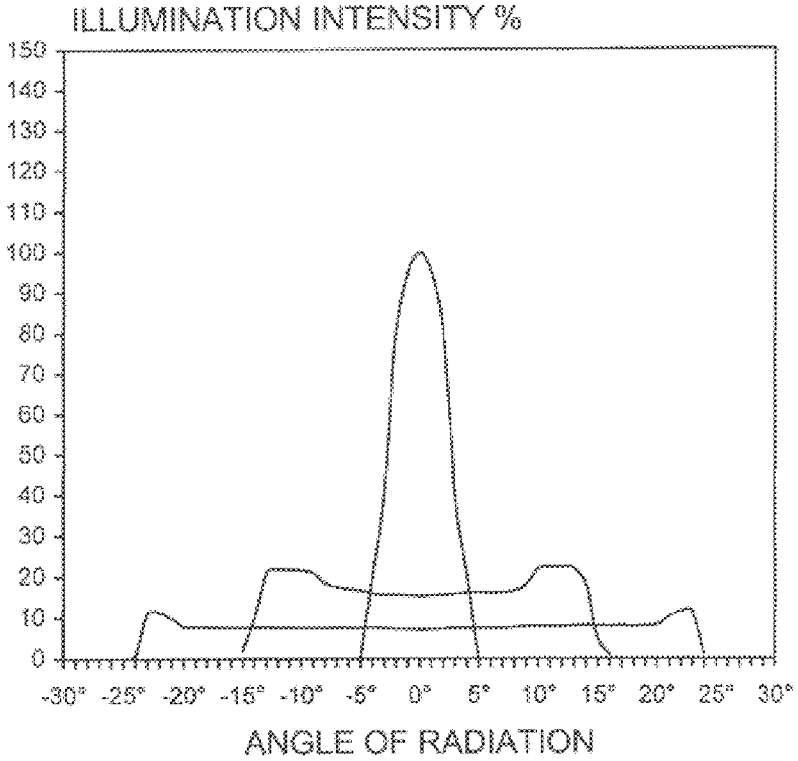
Fig.6a PRIOR ART
Figure 6B:
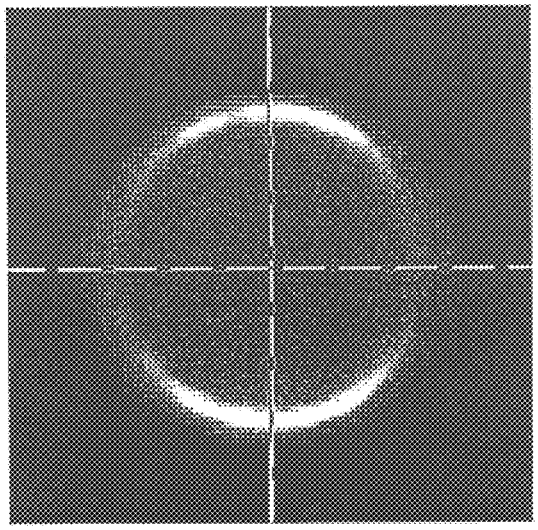
Fig.6b PRIOR ART
Figure 7A:
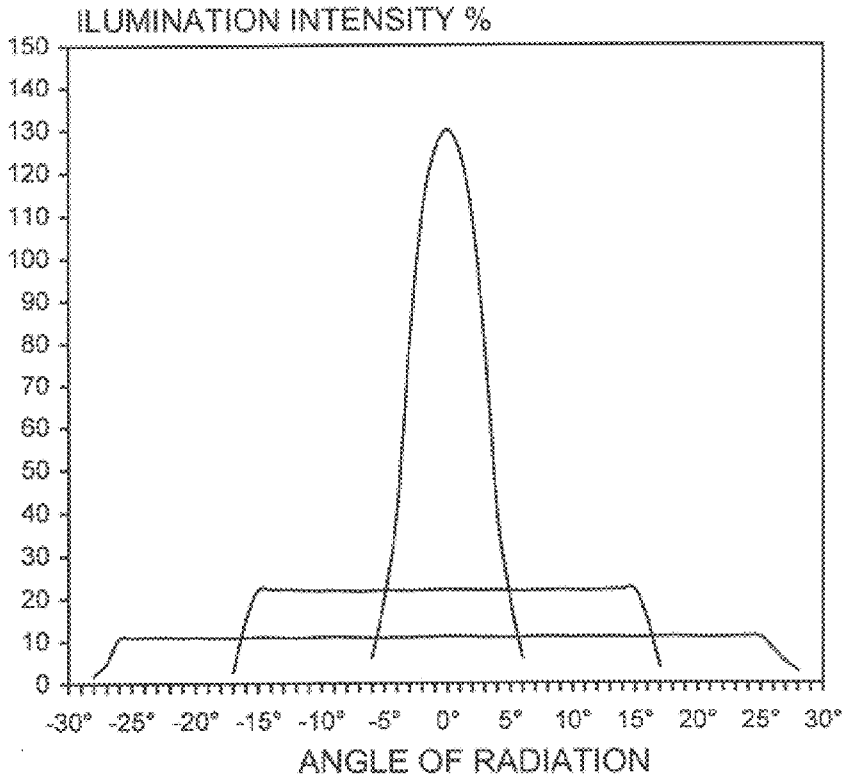
Figure 7B:
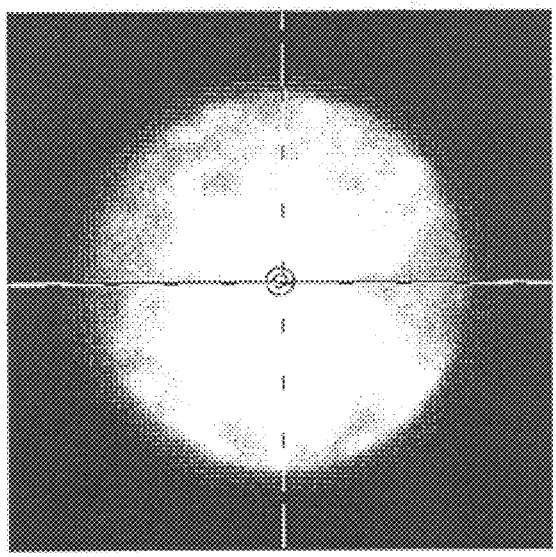
Figure 8:
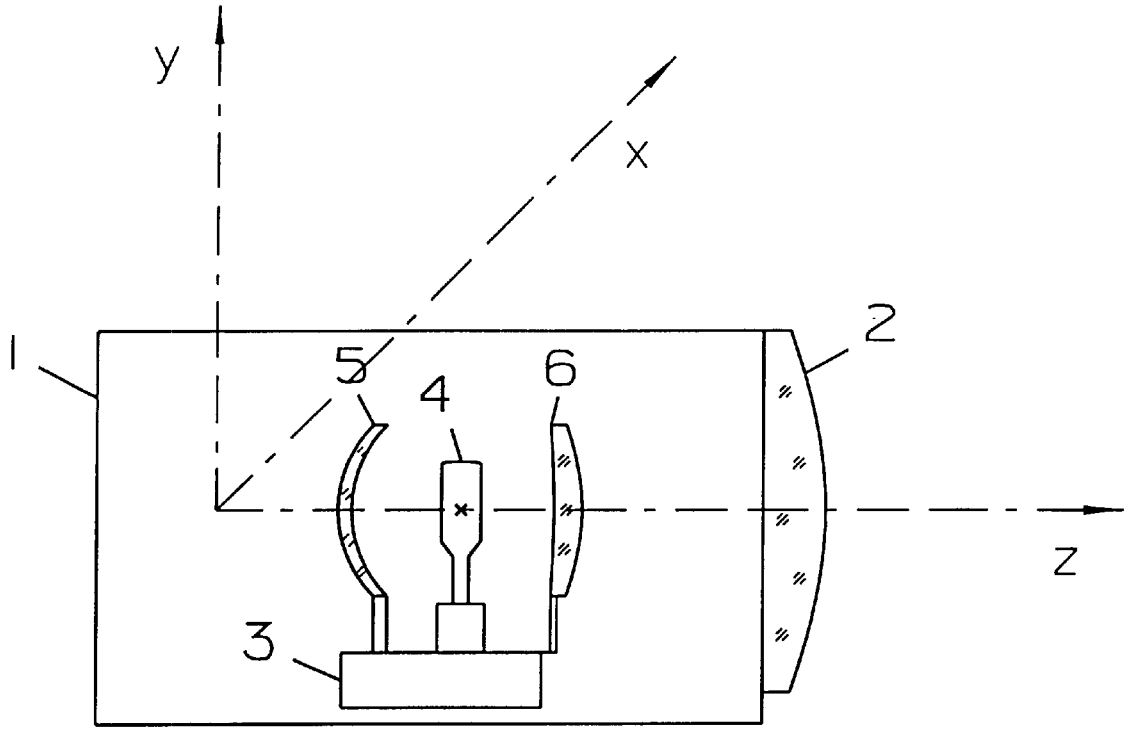

Each of FIGS. 2*a*–2*e* is a schematic cross-sectional view of a further embodiment of a spotlight of this invention, with an optical unit—comprising a light source, a reflector, and second lens—being in different positions in different views, ranging from as close as possible to the first lens, to a position as distant as possible from the first lens;

Each of FIGS. 3*a* through 3*f* is a schematic cross-sectional view of a third embodiment of a spotlight of this invention, with an optical unit—comprising a light source, a reflector, and second lens—being in different positions in different views, ranging from as close as possible to the first lens, to a position as distant as possible from the first lens;

Each of FIGS. 4*a* through 4*c* is a schematic cross-sectional view of a fourth embodiment of a spotlight of this invention, with an optical unit—comprising a light source, a reflector, and second lens—being in different positions in different views, ranging from as close as possible to the first lens, to a position as distant as possible from the first lens;

FIG. 5 is a schematic cross-sectional view of a spotlight known in the prior art having an adjustable angle of radiation and a spherical front lens;

FIG. 6*a* is a graphic plot of light distribution curves of the spotlight of FIG. 5, at various angle of radiation settings;

FIG. 6*b* is a schematic plan view of an area lighted by the spotlight of FIG. 5 at a critical setting of the angle of radiation between the spot setting and the flood setting of the spotlight;

FIG. 7*a* is a graphic plot of light distribution of the spotlight of the invention as in FIGS. 3*a* through 3*f*, in various settings of the angle of radiation;

FIG. 7*b* is a schematic plan view of an area lighted by a spotlight of the invention as in FIGS. 3*a* through 3*f*, at a critical setting of the angle of radiation between the spot setting and the flood setting of the spotlight, and FIG. 8 is a schematic view of an embodiment of the spotlight of the invention with a coordinate system drawn in.

DESCRIPTION OF THE PREFERRED EMBODIMENT

Figure 1A:
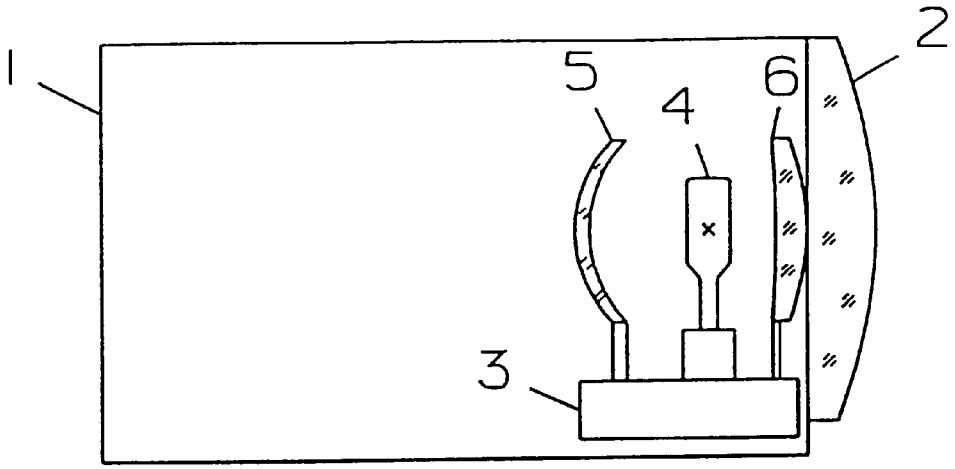

A cross-sectional view of an embodiment of a spotlight of this invention is shown in FIG. 1*a*. The spotlight has a can-like, opaque housing 1, in which a first collector lens 2 is positioned at a light-exiting end, as a front lens of the spotlight. The surface of the first collector lens 2 facing in the radiation direction of the spotlight is rotationally symmetrical and, when seen in meridional section, has the shape of a hyperbolic section, with a vertex of the hyperbola lying on the optical axis of the spotlight. The hyperbola fits the following equation:

$$Z = \frac{1}{r} \cdot \frac{y^2}{1 + \sqrt{1 - (k+1)y^2/r^2}}$$

where k=−1.5 and r=52 mm (k—conic section constant; r—vertex radius of curvature) The basic coordinate system can be seen in FIG. 8.

A surface of the first collector lens 2 facing toward the inside of the spotlight is a plane face. However, it may also exhibit concave curvature. In principle, this applies for all example embodiments of the spotlight of the invention described below.

Inside the housing 1, a light source 4, comprising an incandescent filament bulb with a small filament and a reflector 5 associated with the light source 4, are mounted on a slide 3. The light source 4 and the reflector 5 are mounted so that a resulting beam path is directed toward the first collector lens 2. Furthermore, a second collector (focusing or converging) lens 6 is positioned on the slide 3 in the beam path between the light source 4 and the first collector lens 2. In the illustrated embodiment of the inventive spotlight, the second collector lens 6 is a meniscus lens, the surface facing the first collector lens 2 of which is grained.

The second collector lens 6 is rotationally symmetrical with respect to its optical axis. The grained surface, facing away from the light source 4, of the second collector lens 6 has a shape of a hyperbolic section in the meridional section, with the vertex of the hyperbola lying on the optical axis of the spotlight. The hyperbola fits the following equation:

$$Z = \frac{1}{r} \cdot \frac{y^2}{1 + \sqrt{1 - (k+1)y^2/r^2}}$$

where k=−1.1 and r=24 mm.

The light source 4, the reflector 5, and the second collector lens 6 are mounted so that both a distance between the light source 4 and the second collector lens 6 and a distance between the light source 4 and the reflector 5 can be changed.

It is further possible to apply graining to the first collector lens 2, as well, in order to produce a micro-lens structure. Highly uniform light distribution is achieved in this manner.

FIG. 1*a* shows the light source 4, the reflector 5, and the second collector lens 6 in a position of maximum angle of radiation of the spotlight of this invention. A spacing between the first collector lens 2 and the second collector lens 6, as well as a spacing between the second collector lens 6 and the light source 4 are minimal, relative to dimensions of the spotlight, and a spacing between the light source 4 and the reflector 5 is a maximum spacing as determined by structural mounting conditions.

Figure 1B:
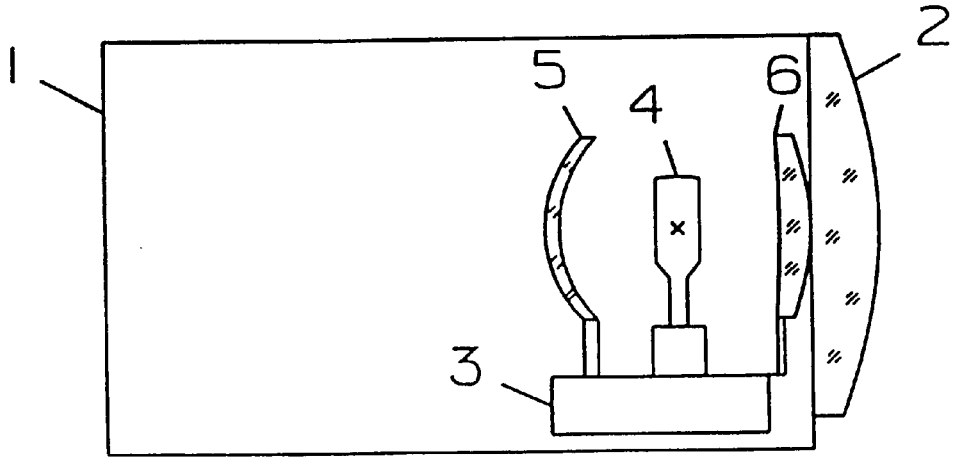

In order to reduce the angle of radiation, the slide 3 is moved from the first collector lens 2. A mechanism of the slide and a guide part coordinating therewith are arranged such that the second collector lens 6 initially remains in its original position, and only the light source 4 and the reflector 5 move away from the first collector lens 2, while retaining their original spacing from each other. This type of movement continues until a spacing between the light source 4 and the second collector lens 6 reaches a predetermined value. FIG. 1*b* shows the optical system of the spotlight of this invention in this specific configuration.

Figure 1C:
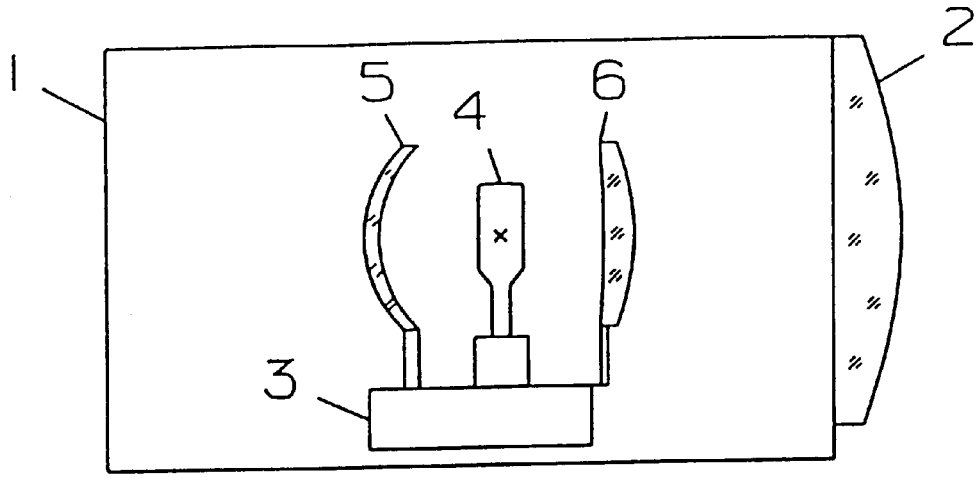

When the slide 3 is moved even further away from the first collector lens 2, as shown in FIG. 1*c*, initially there is no change in the spacing between the light source 4 and the reflector 5 nor in an achieved spacing between the light source 4 and the second collector lens 6. The further the light source 4, the reflector 5, and the second collector lens 6 move away from the first collector lens 2, the smaller the angle of radiation becomes, and the greater is an illuminance of the lighted field.

Figure 1D:
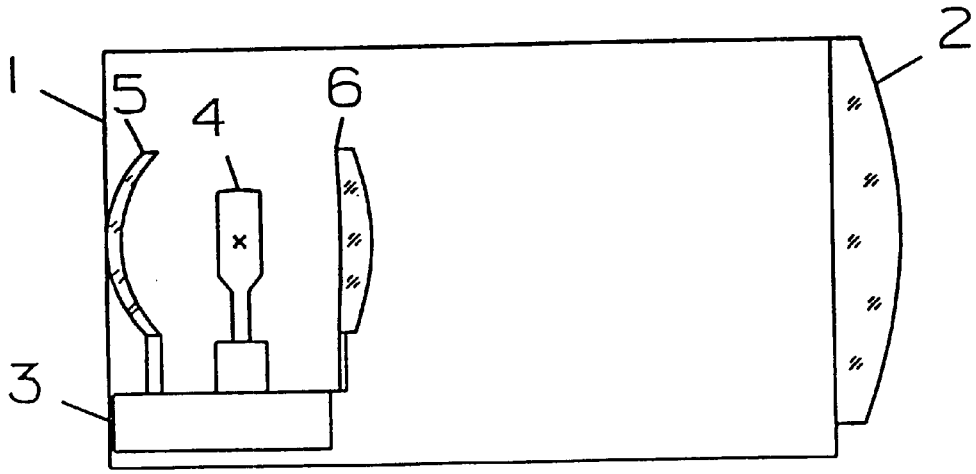
Figure 1E:
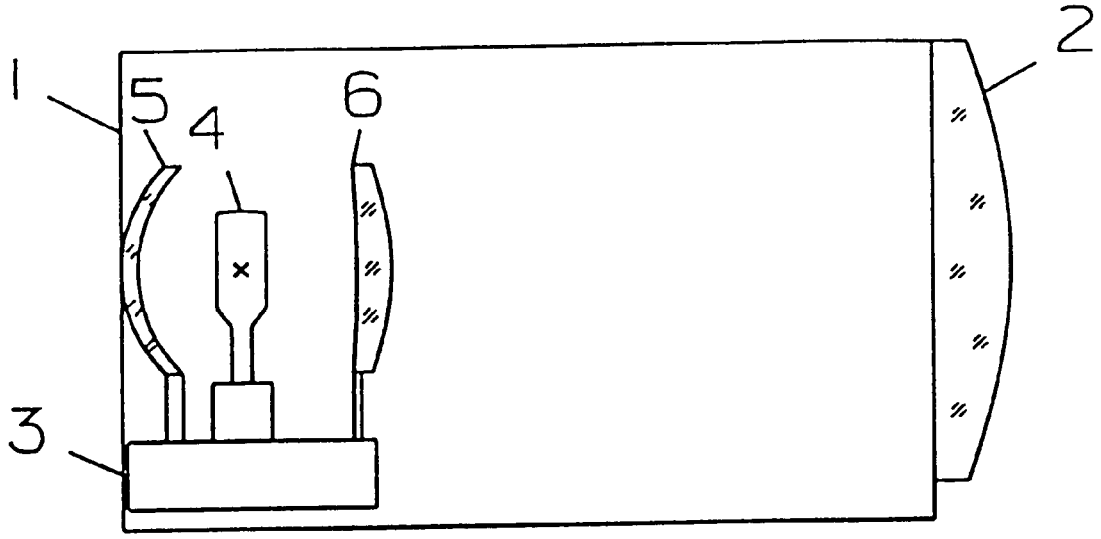
Figure 2A:
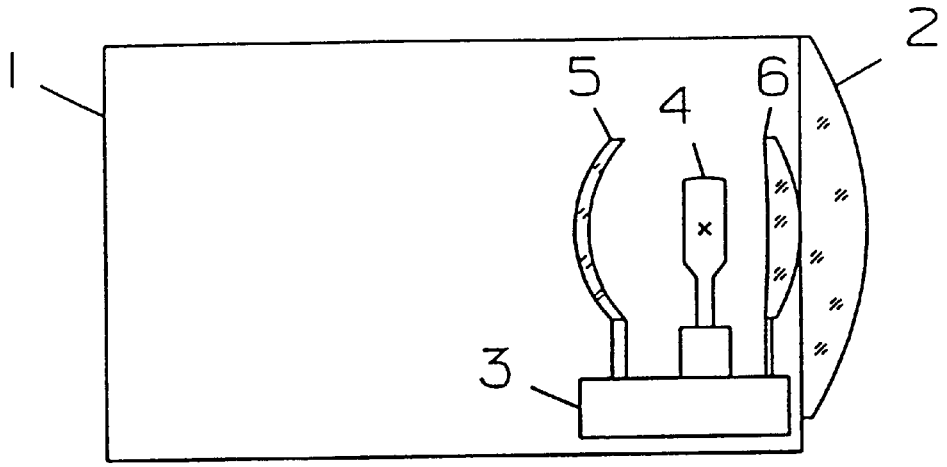
Figure 2B:
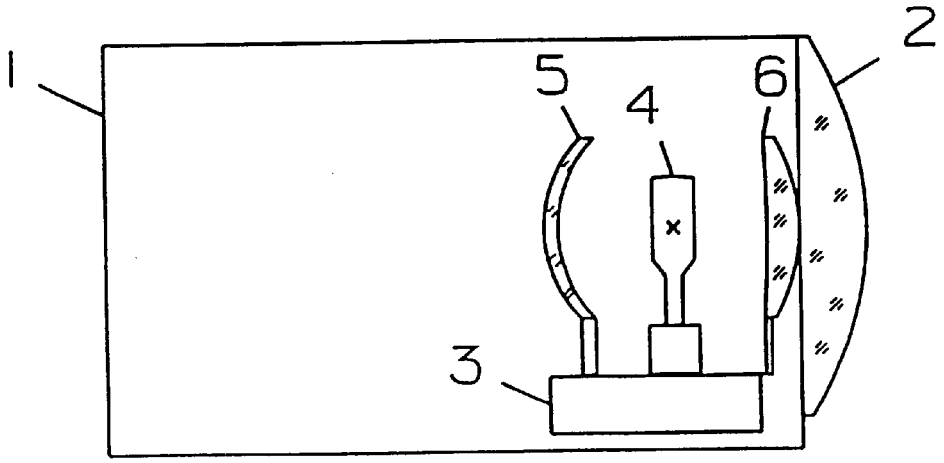
Figure 2C:
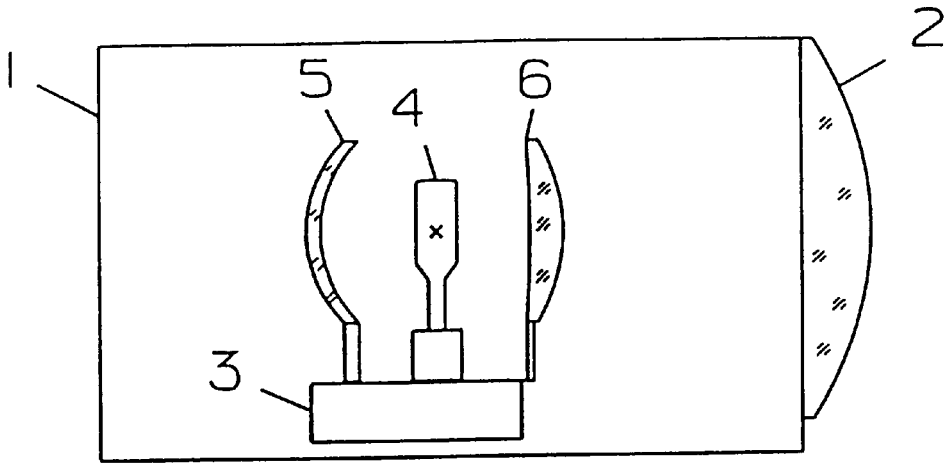
Figure 2D:
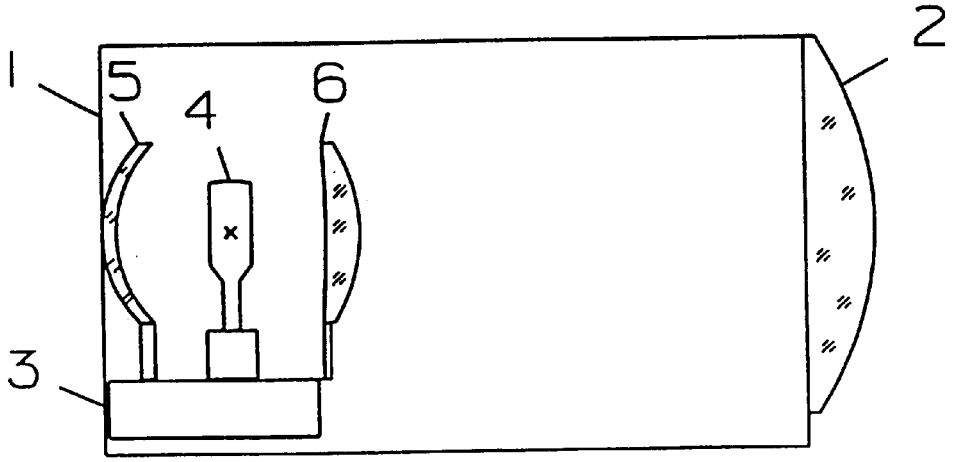
Figure 2E:
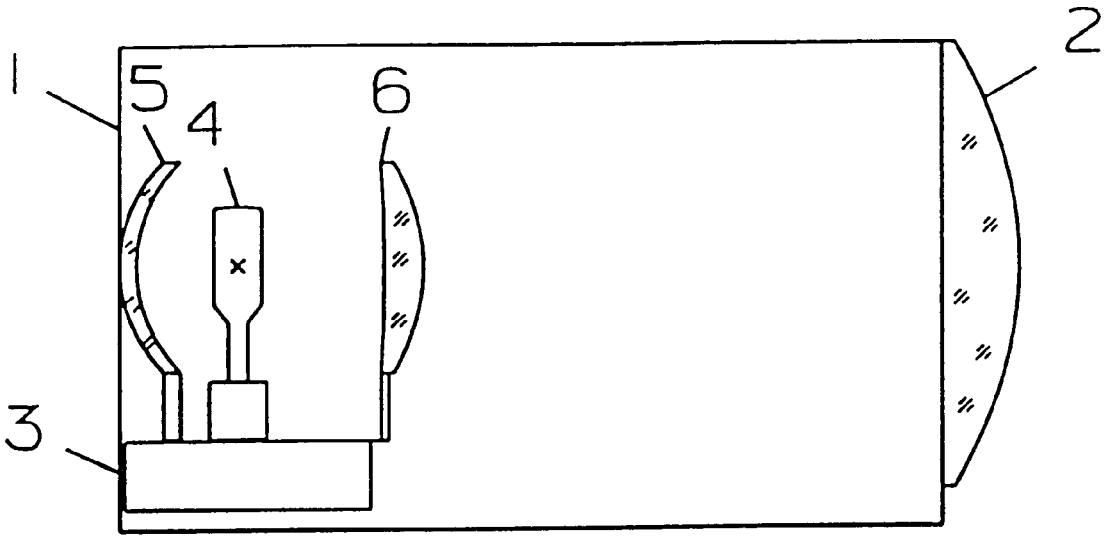

Finally, the reflector 5 reaches a position of maximum separation from the first collector lens 2, as determined by the dimensions of the spotlight, and stops moving (see FIG. 1*d*). This is the position at which the spotlight disclosed in U.S. Pat. No. 4,823,243 achieves its minimum angle of radiation and its maximum illuminance.

On the way from the initial position shown in FIG. 1*a* to the position shown in FIG. 1*d*, the spotlight passes through a critical setting of the angle of radiation in which the spotlight disclosed in U.S. Pat. No. 4,823,243 exhibits brightly illuminated edges in a graphic plot of light distribution curves (see FIGS. 6*a*, 6*b*). By contrast, the spotlight of this invention with the aspherical front lens 2, however, exhibits a very uniform graphic plot of light distribution curves in all settings of the angle of radiation, particularly even in critical settings of the angle of radiation according to the prior art. This is explained in greater detail below, with reference to FIGS. 7*a* and 7*b*, based on another embodiment of the spotlight of this invention.

Based on the mechanical movability of its individual parts, the spotlight of this invention shown in FIGS. 1*a* through 1*e* corresponds to the spotlight disclosed in European Patent 0 846 913. That is, from the spotlight position shown in FIG. 1*d*, it is possible to advance the light source 4 and the second collector lens 6, while maintaining their established relative spacing from one another, even further away from the first collector lens 2, and thereby closer to the reflector 5 (see FIG. 1*e*), while the reflector 5 remains stationary.

A further embodiment of the spotlight of this invention is depicted in FIGS. 2*a* through 2*e*. In this embodiment, as well, the surface of the first collector lens 2 facing in the direction of radiation of the spotlight is rotationally symmetrical with respect to its optical axis, and the surface of the first collector lens 2 facing toward the inside of the spotlight is a plane face. A difference with respect to the embodiment of the spotlight of the invention shown in FIGS. 1*a* through 1*e*, with respect to the first collector lens 2, is that the surface of the first collector lens 2 facing in the direction of radiation of the spotlight has the shape of an elliptical section, with the minor axis of the ellipse lying on the optical axis of the spotlight. The ellipse fits the following equation:

$$Z = \frac{1}{r} \cdot \frac{y^2}{1 + \sqrt{1 - (k+1)y^2/r^2}}$$

where k=−0.6 and r=52 mm.

In the embodiment of the spotlight of the invention shown in FIGS. 2*a* through 2*e*, as well, the second collector lens 6 is a meniscus lens. The surface of the second collector lens 6 facing away from the light source 4 is rotationally symmetrical with respect to its optical axis, and in the meridional section has the shape of an elliptical section, whereby the minor axis of the ellipse lies on the optical axis of the spotlight. The ellipse fits the following equation:

$$Z = \frac{1}{r} \cdot \frac{y^2}{1 + \sqrt{1 - (k+1)y^2/r^2}}$$

where k=−0.6 and r=24 mm.

With respect to the mechanical movability of the individual parts, the embodiment of the inventive spotlight shown in FIGS. 2*a* through 2*e* is substantially like that depicted in FIGS. 1*a* through 1*e*. The one difference is that, when the reflector 5 has reached its distant-most position from the first collector lens 2, as allowed by dimensions of the spotlight, the second collector lens 6 can also not be moved further from the first collector lens 2 in the embodiment shown in FIGS. 2*a* through 2*e*. In this case, only the light source 4 can be moved further toward the reflector 5 while the relative maximum spacing between the second collector lens 6 and the reflector 5 remains constant once the reflector 5 and the second collector lens 6 have reached their furthest-most spacing from the first collector lens 2 for this embodiment (see FIG. 2*e*). The advantages of such a mechanical construction are described in detail in European Patent 0 846 913. The same applies for movement opposite the path, or sequence, of movement described above of the light source 4, the reflector 5, and the second collector lens 6 in the direction of the first collector lens 2. In practice, a simple reversal of the path of movement takes place. See European Patent 0 846 913 for a detailed description.

Figure 3A:
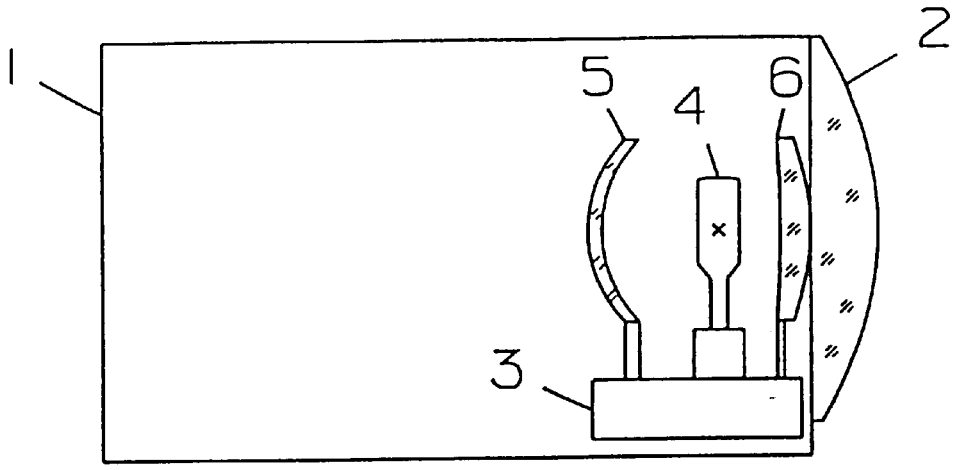
Figure 3B:
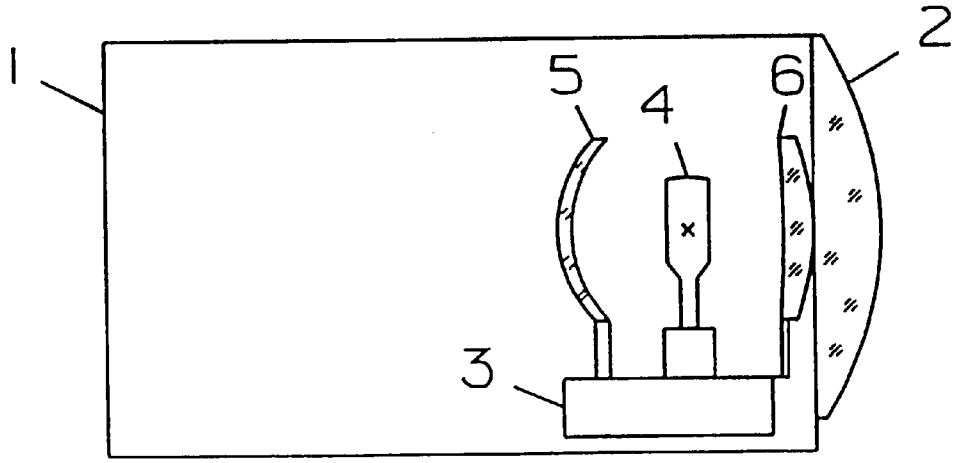
Figure 3C:
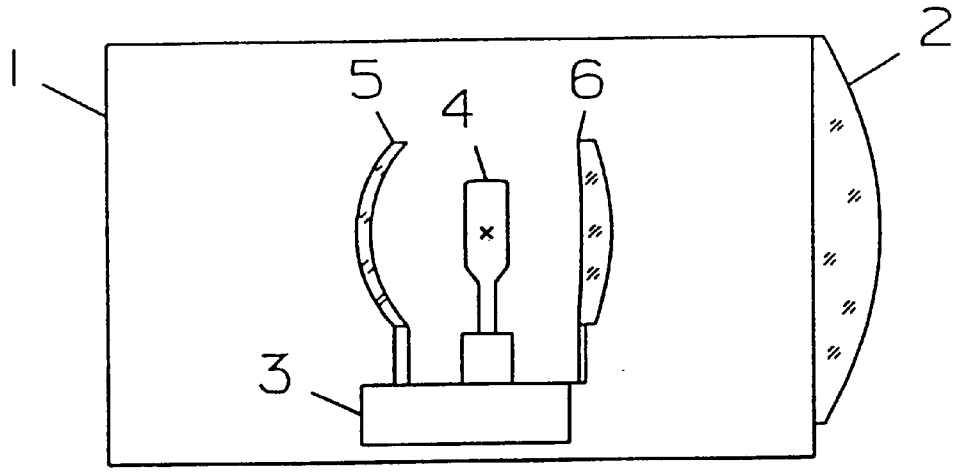
Figure 3D:
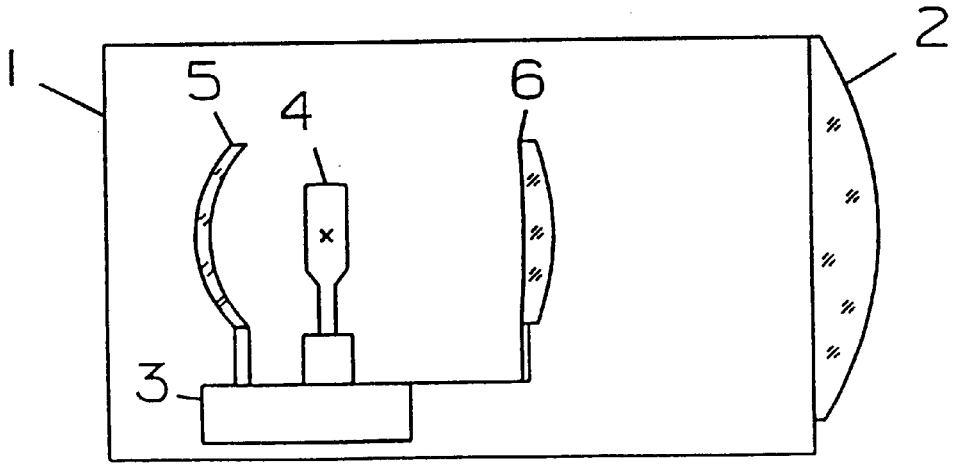
Figure 3E:
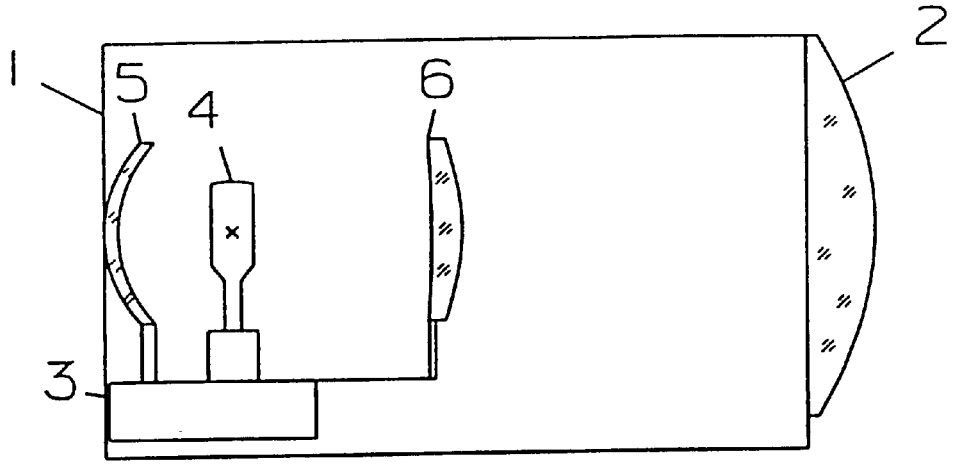
Figure 3F:
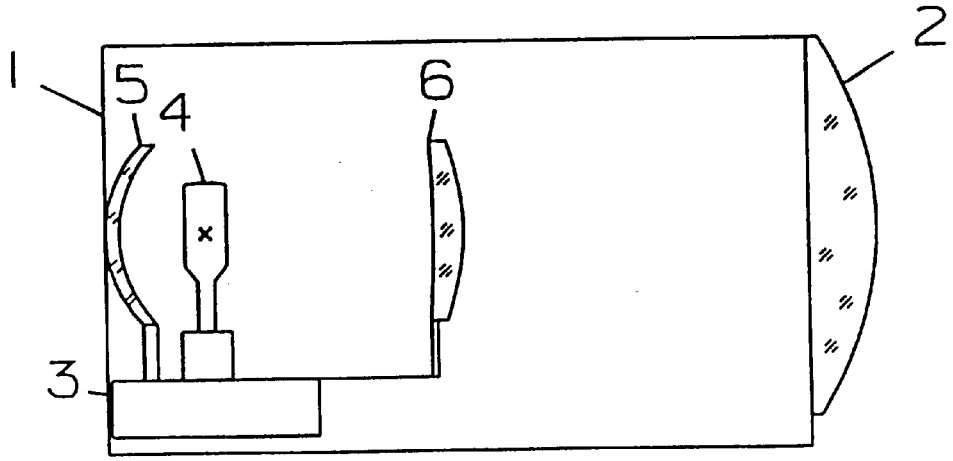

In addition to a mechanical slide system, which makes possible the above-described movements, there are other embodiments of slide systems of the spotlight of this invention which bring about slightly modified movements. Thus, for example, in one embodiment of the spotlight of this invention the second collector lens 6 during a rear portion of the on going movement of the slide 3 from the first collector lens 2 does not abruptly stop, rather, during a constant relative speed between the light source 4 and the first collector lens 2, a relative speed between the second collector lens 6 and the first collector lens 2 is continuously decreased until the second collector lens 6 finally stops while the reflector 5 and the light source 4, while maintaining their relative spacing from one another, move away from the first collector lens 2 (FIGS. 3*a*–3*e*). Finally, the reflector reaches the outward-most position depicted in FIG. 3*e* and only then the light source 4 continues to move away from the first collector lens 2 until the light source 4 finally also reaches its outward-most position (FIG. 3*f*). The reverse of this movement path (or sequence) takes place in a similar manner.

The first collector lens 2 of the embodiment of the spotlight of this invention shown in FIGS. 3*a* through 3*f* corresponds to the first collector lens 2 of the embodiment shown in FIGS. 2*a* through 2*e*, with a difference that the elliptical constants k and r have the following values in the embodiment of FIGS. 3*a* through 3*f:* k=−0.5 r=52 mm

In the embodiment shown in FIGS. 3*a* through 3*f*, the second collector lens 6 is structured as a meniscus lens, the surface of which, facing away from the light source 4, in the meridional section, has the shape of a hyperbolic section, with the vertex of the hyperbola lying on the optical axis of the spotlight. The hyperbola fits the following equation:

$$Z = \frac{1}{r} \cdot \frac{y^2}{1 + \sqrt{1 - (k+1)y^2/r^2}}$$

where k=−1.3 and r=24 mm.

FIG. 7*a* shows the characteristic illuminance curves for the embodiment of the spotlight of this invention illustrated in FIGS. 3*a* through 3*f*. In comparison to the characteristic illuminance curves according to the prior art, shown in FIG. 6*a*, the improved evenness of the lighting by the spotlight of this invention is clear. The intensity increases at the edge that occur outside a spot setting that appeared in devices of the prior art also disappear in an, up-until-now critical, setting of the angle of radiation between the spot setting and the flood setting. FIGS. 6*b* and 7*b* show a direct comparison of the critical settings of the angle of radiation.

In addition to the embodiments of the spotlight according to this invention shown in FIGS. 1*a* through 3*f*, there are many other possible variations of embodiments of the spotlight of this invention. A first collector lens 2 with a hyperbolic surface facing away from the light source 4 in the meridional section can, for example, also be combined with a second collector lens 6, the surface of which that faces away from the light source 4 has the shape of an elliptical section in the meridional section. Such an embodiment of the spotlight of this invention is shown in FIGS. 4*a* through 4*c*. In this embodiment, the surface of the first collector lens 2 facing in the direction of radiation of the spotlight is rotationally symmetrical, and has the shape of a hyperbolic section in the meridional section, with the vertex of the hyperbola lying on the optical axis of the spotlight. The hyperbola fits the following equation:

$$Z = \frac{1}{r} \cdot \frac{y^2}{1 + \sqrt{1 - (k+1)y^2/r^2}}$$

where k=−2 and r=52 mm.

The surface of the first collector lens 2 facing toward the inside of the spotlight is a plane face.

The second collector lens 6 is rotationally symmetrical with respect to its optical axis. The grained surface of the second collector lens 6 facing away from the light source 4 has the shape of an elliptical section in the meridional section, with the vertex of the ellipse lying on the optical axis of the spotlight. The ellipse fits the following equation:

$$Z = \frac{1}{r} \cdot \frac{y^2}{1 + \sqrt{1 - (k+1)y^2/r^2}}$$

where k=−0.4 and r=24 mm.

The movement mechanism in the fourth embodiment of the spotlight of this invention shown in FIGS. 4*a* through 4*c* functions as follows. FIG. 4*a* shows the light source 4, the reflector 5, and the second collector lens 6 in a position of maximum angle of radiation of the spotlight. In order to reduce the angle of radiation, the slide 3 is moved in a direction away from the first collector lens 2. In this embodiment of the spotlight of this invention, a mechanism of the slide and its cooperating guide part are so arranged that spacings separating the second collector lens 6, the light source 4, and the reflector 5 remain unchanged at first. However, once the slide 3 has reached a certain distance from the first collector lens 2, the second collector lens 6 stops moving, while the light source 4 and the reflector 5, maintaining their separation, continue to move together away from the first collector lens 2 and now also move away from the second collector lens 6, until they reach the furthest possible distance from the first collector lens 2, depending on structural conditions (see FIG. 4*c*).

When the slide 3 moves from the spot setting (FIG. 4*c*) into the flood setting (FIG. 4*a*), the movement sequence described above takes place in exactly the reverse order. First the light source 4 and the reflector 5 move toward the two collector lenses 6 and 2, while maintaining their respective separation. Once a particular distance is reached between the light source 4/reflector 5, on the one hand, and the second collector lens 6, on the other hand, the second collector lens 6 joins the movement, and the light source 4, the reflector 5, and the second collector lens 6 then move toward the first collector lens 2 while maintaining their respective spacings.

Mechanically, movement such as that described above with reference to FIGS. 4*a* through 4*c* of the optical elements mounted on the slide 3 can be achieved, for example, by mounting the second collector lens 6 inside the slide 3 on a movable guide rail 7 that extends out beyond the base unit of the slide 3 on the side facing away from the first collector lens 2 and is provided with a spring and a suitable stop device with regard to the light source 4/reflector 5 unit.

For the spotlight of this invention, it is generally true that the second collector lens 6 also does not necessarily have to be constructed as a meniscus lens or as an aspherical lens.

In other embodiments of the spotlight of this invention, the inward-facing surface of the first collector lens 2 is aspherical. Additionally, the slide system does not necessarily have to be constructed as described in U.S. Pat. No. 4,823,243 or in European Patent 0 846 913. Therefore, there are also embodiments of the spotlight of this invention in which the distance between the reflector 5, the light source 4, and the second collector lens 6 cannot be changed. In these embodiments, it is possible only to move the three elements referenced above together as a fixed optical unit, with help of the slide 3, relative to the first collector lens 2. Neither the possible design variants of the first lens 2 as an aspherical lens nor the design variants of the second lens 6 are impaired by this mechanical construction.

Furthermore, it is not absolutely necessary that a rotationally symmetrical lens be used as an aspherical front lens 2. Embodiments having non-rotationally symmetrical aspherical lenses are also possible. If this is the case, and as described above, aspherical lenses having hyperbolic or ellipsoid surfaces are used, these do not necessarily have to be arranged so that the vertex of the hyperbola or the minor ellipse semi-axes lie on the optical axis of the spotlight. Embodiments are also conceivable in which the corresponding lenses are arranged so that they are displaced with respect to the optical axis of the spotlight. This applies both for the first collector lens 2 and the second collector lens 6.

In FIGS. 1*a* through 3*f*, the reflector 5 is constantly depicted as a relatively flat reflector and the light source 4 is depicted as a vertically standing incandescent lamp. It is, however, possible to employ a deep reflector and/or horizontal lamp.

In place of the incandescent filament bulb specified in the above embodiment, the light source 4 may be formed as a halogen bulb or a filament-less discharge lamp with a light spot between two electrodes.

Although the use of an aspherical front lens in combination with a very special spotlight having an adjustable angle of radiation has been described above, in which the aspherical front lens, particularly in the spotlight settings between the spot setting and flood setting, provides a more even light distribution in comparison to such spotlights known in the prior art, aspherical front lenses may also be used in all other possible spotlights with adjustable angles of radiation, in order to influence the light distribution of the spotlights. This is particularly true for spotlights having replaceable front lenses. In this arrangement, the aspherical front lens may be rotationally symmetrical or rotationally non-symmetrical, as well as centered on the optical axis of the spotlight or displaced with respect to the optical axis of the spotlight.

In addition to the values specified above, the conic section constants r and k may also assume many other values. The actual significant range of values of r, for practical applications, is from 15 mm to 150 mm. If k is less than 0, but greater than −1, the equation indicated above yields an ellipsoid surface. A parabolic surface results when $k=-1$, and a hyperbolic surface when $k<-1$. The value of k may be as small as desired, and r is also not limited to the range of values indicated above.

Finally, it is expressly stated that the invention is not limited to a specific power class of spotlights. For example, spotlights of this invention may be structured as miniature spotlights having a capacity of some 10 W and as a high-power spotlight having a capacity of some 10 kW.

While the invention has been particularly shown and described with reference to a preferred embodiment, it will be understood by those skilled in the art that various changes in form and detail may be made therein without departing from the spirit and scope of the invention.

The invention claimed is:

1. A spotlight for illuminating an area with an adjustable angle of radiation, wherein modification of the angle of radiation is achieved in a manner other than shading the beam path with a screen or mask, said spotlight comprising an interior light source (4), a first lens (2) that is a front lens of the spotlight, wherein the first lens (2) is an aspherical lens, a reflector (5) associated with the light source (4), and a second lens (6) placed in a light-beam path between the light source (4) and the first lens (2), whereby the reflector (5), the light source (4), and the second lens (6) are mounted as an optical unit that is movable along an optical axis of the spotlight relative to the first lens (2).

2. The spotlight as in claim 1, wherein the first lens (2) is grained on at least one surface.

3. The spotlight as in claim 1, wherein the first lends (2) is rotationally symetrical with respect to its optical axis.

4. The spotlight as in claim 1, wherein a surface of the first lens (2) facing the inside of the spotlight is aspherical.

5. The spotlight as in claim 1, wherein a surface of the first lens (2) facing in a direction of radiation of the spotlight, as seen from a meridional section of the first lens, has a shape of a conic section that is different from a segment of a circle.

6. The spotlight as in claim 5, wherein the surface of the first lens (2) facing in the direction of radiation of the spotlight in the meridional section has the shape of a hyperbolic section.

7. The spotlight as in claim 6, wherein a vertex of a hyperbolic section lies on an optical axis of the spotlight.

8. The spotlight as in claim 7, wherein the hyperbola fits the following equation:

$$Z = \frac{1}{r} \cdot \frac{y^2}{1 + \sqrt{1 - (k+1)y^2/r^2}}$$

where k is a value ranging from −3.0 to −1.1 and r is a value ranging from 40 mm to 100 mm.

9. The spotlight as in claim 5, wherein the surface of the first lens (2) facing in the direction of radiation of the spotlight in the meridional section has the shape of an elliptical section.

10. The spotlight as in claim 9, wherein a minor axis of an ellipse of the elliptical section lies on the optical axis of the spotlight.

11. The spotlight as in claim 10, wherein the ellipse fits the following equation:

$$Z = \frac{1}{r} \cdot \frac{y^2}{1 + \sqrt{1 - (k+1)y^2/r^2}}$$

where k is a value ranging from −0.9 to −0.5 and r is a value ranging from 40 mm to 100 mm.

12. The spotlight as in claim 1, wherein a surface of the first lens (2) facing an inside of the spotlight is spherical.

13. The spotlight as in claim 1, wherein a surface of the first lens (2) facing an inside of the spotlight is flat or is curved in a direction away from the light source (4).

14. The spotlight as in claim 1, wherein the second lens (6) is grained on at least one surface.

15. The spotlight as in claim 1, wherein the second lens (6) is rotationally symmetrical with respect to its optical axis.

16. The spotlight as in claim 1, wherein the second lens (6) is an aspherical lens.

17. The spotlight as in claim 16, wherein a surface of the second lens (6) that faces the light source (4) is aspherical.

18. The spotlight as in claim 16, wherein a surface of the second lens (6) facing away from the light source (4), as seen in a meridional section, has a shape of a conic section that is different from a segment of a circle.

19. The spotlight as in claim 18, wherein the surface of the second lens (6) facing away from the light source (4), as seen in a meridional section, has a shape of a hyperbolic section.

20. The spotlight as in claim 19, wherein a vertex of a hyperbola of the hyperbolic section lies on the optical axis of the spotlight.

21. The spotlight as in claim 20, wherein the hyperbola fits the following equation:

$$Z = \frac{1}{r} \cdot \frac{y^2}{1 + \sqrt{1 - (k+1)y^2/r^2}}$$

where k is a value ranging from −3.0 to −1.1 and r is a value ranging from 20 mm to 70 mm.

22. The spotlight as in claim 18, wherein the surface of the second lens (6) facing away from the light source (4), as seen in a meridional section, has a shape of an elliptical section.

23. The spotlight as in claim 22, wherein a minor axis of an ellipse of the elliptical section lies on the optical axis of the spotlight.

24. The spotlight as in claim 23, wherein the ellipse fits the following equation:

$$Z = \frac{1}{r} \cdot \frac{y^2}{1 + \sqrt{1 - (k+1)y^2/r^2}}$$

where k is a value ranging from −0.9 to −0.5 and r is a value ranging from 20 mm to 70 mm.

25. The spotlight as in claim 1, wherein the second lens (6) is a meniscus lens.

26. The spotlight as in claim 1, wherein a spacing between the light source (4) and the second lens (6) is adjustable within the optical unit.

27. The spotlight as in claim 1, wherein a spacing between the light source (4) and the reflector (5) is adjustable within the optical unit.

28. A spotlight for illuminating an area with an adjustable angle of radiation, wherein modification of the angle of radiation is achieved in a manner other than shading the beam path with a screen or mask, said spotlight comprising an interior light source (4) and a first lens (2) that is a front lens of the spotlight, wherein the first lens (2) is an aspherical lens and a surface of the first lens (2) facing in a direction of radiation of the spotlight, as seen from a meridional section of the first lens, has a shape of a hyperbolic section, and a vertex of a hyperbola of the hyperbolic section lies on an optical axis of the spotlight, the hyperbola fitting the following equation:

$$Z = \frac{1}{r} \cdot \frac{y^2}{1 + \sqrt{1 - (k+1)y^2/r^2}}$$

where k is a value ranging from −3.0 to −1.1 and r is a value ranging from 40 mm to 100 mm.

29. A spotlight for illuminating an area with an adjustable angle of radiation, wherein modification of the angle of radiation is achieved in a manner other than shading the beam path with a screen or mask, said spotlight comprising an interior light source (4) and a first lens (2) that is a front lens of the spotlight, wherein the first lens (2) is an aspherical lens and a surface of the first lens (2) facing in a direction of radiation of the spotlight, as seen from a meridional section of the first lens, has a shape of an elliptical section, and a minor axis of an ellipse of the elliptical section lies on the optical axis of the spotlight, the ellipse fitting the following equation:

$$Z = \frac{1}{r} \cdot \frac{y^2}{1 + \sqrt{1 - (k+1)y^2/r^2}}$$

where k is a value ranging from −0.9 to −0.5 and r is a value ranging from 40 mm to 100 mm.

30. A spotlight for illuminating an area with an adjustable angle of radiation, wherein modification of the angle of radiation is achieved in a manner other than shading the beam path with a screen or mask, said spotlight comprising an interior light source (4) and a first lens (2) that is a front lens of the spotlight, wherein the first lens (2) is an aspherical Fresnel lens.

31. The spotlight as in claim 30, wherein the first lens (2) is grained on at least one surface.

32. The spotlight as in claim 30, wherein the first lens (2) is rotationally symmetrical with respect to its optical axis.

33. The spotlight as in claim 30, wherein is further included, a reflector (5) associated with the light source (4), and a second lens (6) placed in a light-beam path between the light source (4), and the first lens (2), whereby the reflector (5), the light source (4), and the second lens (6) are mounted as an optical unit that is movable along an optical axis of the spotlight relative to the first lens (2).

34. The spotlight as in claim 33, wherein the second lens (6) is grained on at least one surface.

35. The spotlight as in claim 33, wherein the second lens (6) is rotationally symmetrical with respect to its optical axis.

36. The spotlight as in claim 33, wherein the second lens (6) is an aspherical lens.

37. The spotlight as in claim 36, wherein a surface of the second lens (6) that faces the light source (4) is aspherical.

38. The spotlight as in claim 36, wherein a surface of the second lens (6) facing away from the light source (4), as seen in a meridional section, has a shape of a conic section that is different from a segment of a circle.

39. The spotlight as in claim 38, wherein the surface of the second lens (6) facing away from the light source (4), as seen in a meridional section, has a shape of a hyperbolic section.

40. The spotlight as in claim 39, wherein a vertex of a hyperbola of the hyperbolic section lies on the optical axis of the spotlight.

41. The spotlight as in claim 40, wherein the hyperbola fits the following equation:

$$Z = \frac{1}{r} \cdot \frac{y^2}{1 + \sqrt{1 - (k+1)y^2/r^2}}$$

where k is a value ranging from −3.0 to −1.1 and r is a value ranging from 20 mm to 70 mm.

42. The spotlight as in claim 38, wherein the surface of the second lens (6) facing away from the light source (4), as seen in a meridional section, has a shape of an elliptical section.

43. The spotlight as in claim 42, wherein a minor axis of an ellipse of the elliptical section lies on the optical axis of the spotlight.

44. The spotlight as in claim 43, wherein the ellipse fits the following equation:

$$Z = \frac{1}{r} \cdot \frac{y^2}{1 + \sqrt{1 - (k+1)y^2/r^2}}$$

where k is a value ranging from −0.9 to −0.5 and r is a value ranging from 20 mm to 70 mm.

45. The spotlight as in claim 33, wherein the second lens (6) is a meniscus lens.

46. The spotlight as in claim 33, wherein a spacing between the light source (4) and the second lens (6) is adjustable within the optical unit.

47. The spotlight as in claim 33, wherein a spacing between the light source (4) and the reflector (5) is adjustable within the optical unit.

* * * * *